US011015868B2

(12) United States Patent
Gulbranson et al.

(10) Patent No.: US 11,015,868 B2
(45) Date of Patent: May 25, 2021

(54) HAY BALE DRYER

(71) Applicants: Emil Jacob Gulbranson, Vanderhoof (CA); Chandler Blain Gulbranson, Vanderhoof (CA)

(72) Inventors: Emil Jacob Gulbranson, Vanderhoof (CA); Chandler Blain Gulbranson, Vanderhoof (CA)

( * ) Notice: Subject to any disclaimer, the term of this patent is extended or adjusted under 35 U.S.C. 154(b) by 0 days.

(21) Appl. No.: 15/957,275

(22) Filed: Apr. 19, 2018

(65) Prior Publication Data

US 2018/0306503 A1 Oct. 25, 2018

Related U.S. Application Data

(63) Continuation-in-part of application No. 15/496,397, filed on Apr. 25, 2017, now abandoned.

(51) Int. Cl.

| | |
|---|---|
| ***F26B 21/00*** | (2006.01) |
| ***F26B 9/10*** | (2006.01) |
| ***F26B 3/06*** | (2006.01) |
| ***F26B 9/04*** | (2006.01) |
| ***F26B 19/00*** | (2006.01) |

(52) U.S. Cl.

CPC ..... *F26B 21/004* (2013.01); *F26B 3/06* (2013.01); *F26B 9/04* (2013.01); *F26B 9/10* (2013.01); *F26B 19/005* (2013.01); *F26B 21/001* (2013.01)

(58) Field of Classification Search

CPC .. F26B 21/004; F26B 3/06; F26B 9/04; F26B 9/10; F26B 19/005; F26B 21/001

USPC ..... 34/475

See application file for complete search history.

(56) References Cited

U.S. PATENT DOCUMENTS

| | | | | |
|---|---|---|---|---|
| 1,332,629 A | | 3/1920 | McIntyre | |
| 1,946,814 A | | 2/1934 | Sims | |
| 4,149,844 A | * | 4/1979 | Noyes | F26B 17/122 34/174 |
| 4,185,549 A | | 1/1980 | Roepnack | |
| 4,249,842 A | * | 2/1981 | Johnson | A01D 90/083 414/24.5 |

(Continued)

FOREIGN PATENT DOCUMENTS

| | | |
|---|---|---|
| AT | 14386 U1 | 10/2015 |
| CA | 2099803 A1 | 1/1995 |

(Continued)

OTHER PUBLICATIONS

European Patent Office, "Extended European Search Report" in connection with related European Patent Application No. 18020557.7, dated Apr. 9, 2019, 10 pages.

(Continued)

*Primary Examiner* — Stephen M Gravini

(74) *Attorney, Agent, or Firm* — Kolisch Hartwell, P.C.

(57) ABSTRACT

The present invention provides a hay bale dryer, comprising: a platform, the platform dimensioned to support the hay bale; a spike rack movably coupled to the platform, the spike rack having a plurality of spikes, each spike having a plurality of slots and each spike dimensioned to penetrate through the hay bale; a fan coupled to the spike rack and operative to blow air through the slots in the spikes, wherein the spike rack is raised to permit loading and unloading of the hay bale, and lowered to permit drying of the hay bale via the air blown through the spikes.

29 Claims, 10 Drawing Sheets

(56) References Cited

U.S. PATENT DOCUMENTS

| | | | | | |
|---|---|---|---|---|---|
| 4,253,244 | A * | 3/1981 | Kranzler | F26B 25/22 34/233 |
| 4,450,178 | A | 5/1984 | Korsgaard | |
| 4,459,798 | A | 7/1984 | Penfold et al. | |
| 4,530,167 | A * | 7/1985 | Hotovy | A23B 9/08 34/233 |
| 4,538,948 | A * | 9/1985 | Melton | A01D 87/127 241/101.76 |
| 4,566,205 | A * | 1/1986 | Schlagel | B65D 88/742 34/232 |
| 4,640,021 | A | 2/1987 | Gullickson | |
| 4,914,834 | A * | 4/1990 | Sime | F26B 17/124 34/169 |
| D335,675 | S | 5/1993 | Herron | |
| 5,789,072 | A | 8/1998 | Ulrich | |
| 5,992,049 | A * | 11/1999 | Trost | F26B 21/08 34/174 |
| 6,079,119 | A | 6/2000 | Magnusson | |
| 6,988,325 | B2 | 1/2006 | Philippe et al. | |
| 7,322,173 | B2 * | 1/2008 | Desnoyers | A01D 85/002 53/211 |
| 9,015,958 | B2 * | 4/2015 | Bloemendaal | F26B 3/06 34/386 |
| 2005/0172701 | A1 | 8/2005 | Loucks et al. | |
| 2014/0007451 | A1 * | 1/2014 | Brown, Jr. | A01F 25/00 34/265 |
| 2014/0250717 | A1 | 9/2014 | Bloemendaal | |
| 2018/0306502 | A1 * | 10/2018 | Gulbranson | F26B 21/004 |
| 2018/0306503 | A1 * | 10/2018 | Gulbranson | F26B 21/004 |
| 2018/0328662 | A1 | 11/2018 | Niklaus et al. | |
| 2019/0024973 | A1 | 1/2019 | Martin et al. | |

FOREIGN PATENT DOCUMENTS

| | | | | |
|---|---|---|---|---|
| CA | 2987525 | A1 | 2/2018 | |
| CA | 3017327 | A1 | 2/2018 | |
| CA | 2965009 | A1 | 10/2018 | |
| CA | 3002202 | A1 | 10/2018 | |
| DE | 2160866 | A1 | 6/1973 | |
| DE | 2854559 | A1 | 6/1980 | |
| DE | 3641975 | C1 | 1/1988 | |
| DE | 9015958 | U1 * | 6/1991 | F25B 45/00 |
| DE | 202014000930 | U1 | 5/2015 | |
| DE | 202015106039 | U1 | 2/2017 | |
| EP | 0361099 | A1 | 4/1990 | |
| EP | 1057400 | A2 | 12/2000 | |
| EP | 2465338 | A1 | 6/2012 | |
| EP | 2775239 | A2 | 9/2014 | |
| EP | 2775239 | A3 | 9/2014 | |
| GB | 2207495 | A | 2/1989 | |
| IT | MO930024 | A1 | 9/1994 | |
| JP | 4149844 | B2 * | 9/2008 | |
| JP | 4253244 | B2 * | 4/2009 | |
| JP | 4530167 | B2 * | 8/2010 | G09G 3/344 |
| JP | 4566205 | B2 * | 10/2010 | |
| JP | 4914834 | B2 * | 4/2012 | G01J 3/46 |
| JP | 5992049 | B2 * | 9/2016 | A61K 31/517 |
| KR | 20140007451 | A * | 1/2014 | F16J 15/3224 |
| SU | 917772 | A1 | 4/1982 | |
| WO | WO-9015958 | A1 * | 12/1990 | F24F 6/043 |
| WO | 9730318 | A1 | 8/1997 | |
| WO | 2010026451 | A1 | 3/2010 | |
| WO | 2011026493 | A2 | 3/2011 | |
| WO | 2012001461 | A1 | 1/2012 | |

OTHER PUBLICATIONS

Photograph posted to Twitter, dated Aug. 12, 2016, 1 pg.

Photographs of prototype hay bale dryer that may have been demonstrated on Aug. 12, 2016, 2 pgs.

U.S. Patent and Trademark Office, Declaration of Attribution and Prior Public Disclosure Under 37 CFR 1.130 in U.S. Appl. No. 16/039,408, dated Apr. 6, 2020, 22 pages.

* cited by examiner

HAY BALE DRYER

CROSS-REFERENCE TO RELATED APPLICATION

The present application is a continuation-in-part of U.S. patent application Ser. No. 15/496,397, filed Apr. 25, 2017, which is hereby incorporated by reference.

FIELD OF THE INVENTION

The present specification relates generally to dryers for hay bales, and, in particular, to an air-injection drying system for one or more hay bales.

BACKGROUND OF THE INVENTION

After harvesting, hay is stored in bales, which need to be below a specific moisture level (generally 12%) to prevent spoilage during storage. This is typically done by cutting the hay, then leaving it in the fields to dry prior to being baled. Under ideal conditions, cut hay starts at approximately 75% moisture, which is reduced to around 40% within the first 24 hours and to around 25% in the next 48. However, to get down to 12% typically requires another 72 hours. Therefore, a clear weather window for 5 days is required for harvesting hay. This creates a risk of the hay being exposed to further moisture prior to baling as a consequence of a change in weather patterns. Furthermore, hay left too long may become too dry, leading to a loss of leaves and a reducing harvest.

It would be preferable to harvest hay at a 25% moisture level, and then to dry the bales to the required moisture level thereafter. This would reduce the required weather window significantly, as well as enabling earlier field irrigation to reduce the chances of plants going dormant. However, drying hay bales presents a challenge. Hay bales are generally quite large in size (typically 3 feet by 4 feet by 8 feet) and drying the interior hay flakes through exterior drying means is difficult. Ideally, a drying process should penetrate the interior of the hay bale, as well as enabling reasonably rapid drying of high-moisture bales.

Accordingly, there remains a need for improvements in the art.

SUMMARY OF THE INVENTION

In accordance with an aspect of the invention, there is provided an air injection hay bale dryer using spikes to penetrate the interior of the hay bale.

According to an embodiment of the invention, there is provided a hay bale dryer, comprising: a platform, the platform dimensioned to support the hay bale; a spike rack movably coupled to the platform, the spike rack having a plurality of spikes, each spike having a plurality of slots and each spike dimensioned to penetrate through the hay bale; a fan coupled to the spike rack and operative to blow air through the slots in the spikes, wherein the spike rack is raised to permit loading and unloading of the hay bale, and lowered to permit drying of the hay bale via the air blown through the spikes.

According to another embodiment of the invention, there is provided a hay bale drying system, comprising: a plurality of hay bale dryers, each hay bale dryer comprising: a platform, the platform dimensioned to support the hay bale; and a spike rack movably coupled to the platform, the spike rack having a plurality of spikes, each spike having a plurality of slots and each spike dimensioned to penetrate through the hay bale. The hay bale drying system further comprises a fan coupled to each of the hay bale dryers in line and operative to blow air through the slots in the spikes, wherein each spike rack is independently raised to permit loading and unloading of its respective hay bale, and lowered to permit drying of the hay bale via the air blown through the spikes.

According to another embodiment of the invention, there is provided a method of drying a hay bale located on a platform to a desired moisture level, comprising: lowering a spike rack movably coupled to the platform, the spike rack having a plurality of spikes, each spike having a plurality of slots and each spike dimensioned to penetrate through the hay bale; activating a fan coupled to the spike rack to blow air through the spikes; and raising the spike rack once the process is complete.

Other aspects and features according to the present application will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example only, embodiments of the invention, and how they may be carried into effect, and in which.

Like reference numerals indicated like or corresponding elements in the drawings.

DETAILED DESCRIPTION OF THE EMBODIMENTS

The present invention is a dryer for hay bales and, in particular, to an air injection dryer for hay bales.

Figure 1A:
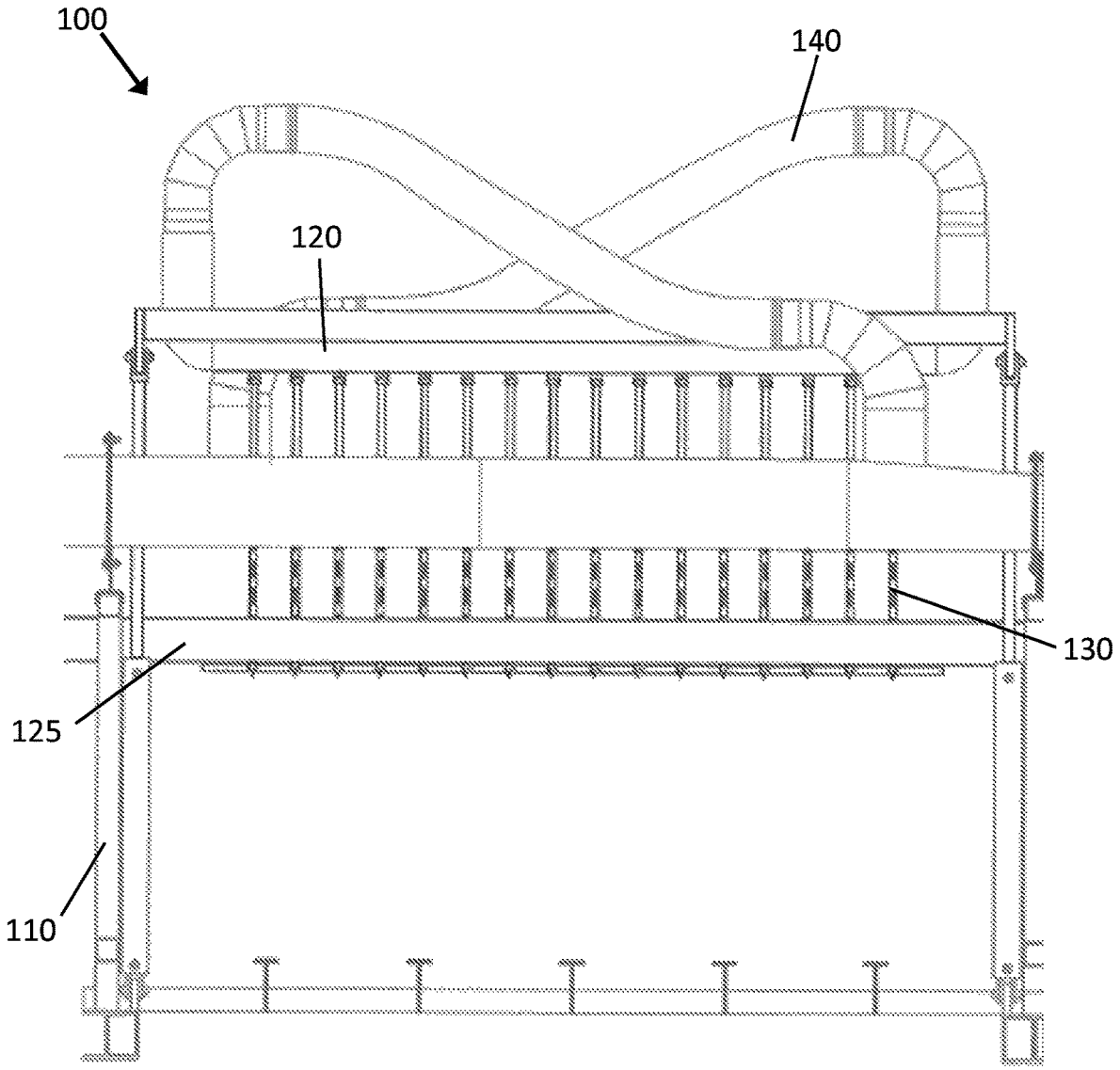
FIG. 1A is a front elevation view of a hay bale dryer with the spike rack raised according to an embodiment.
Figure 1B:
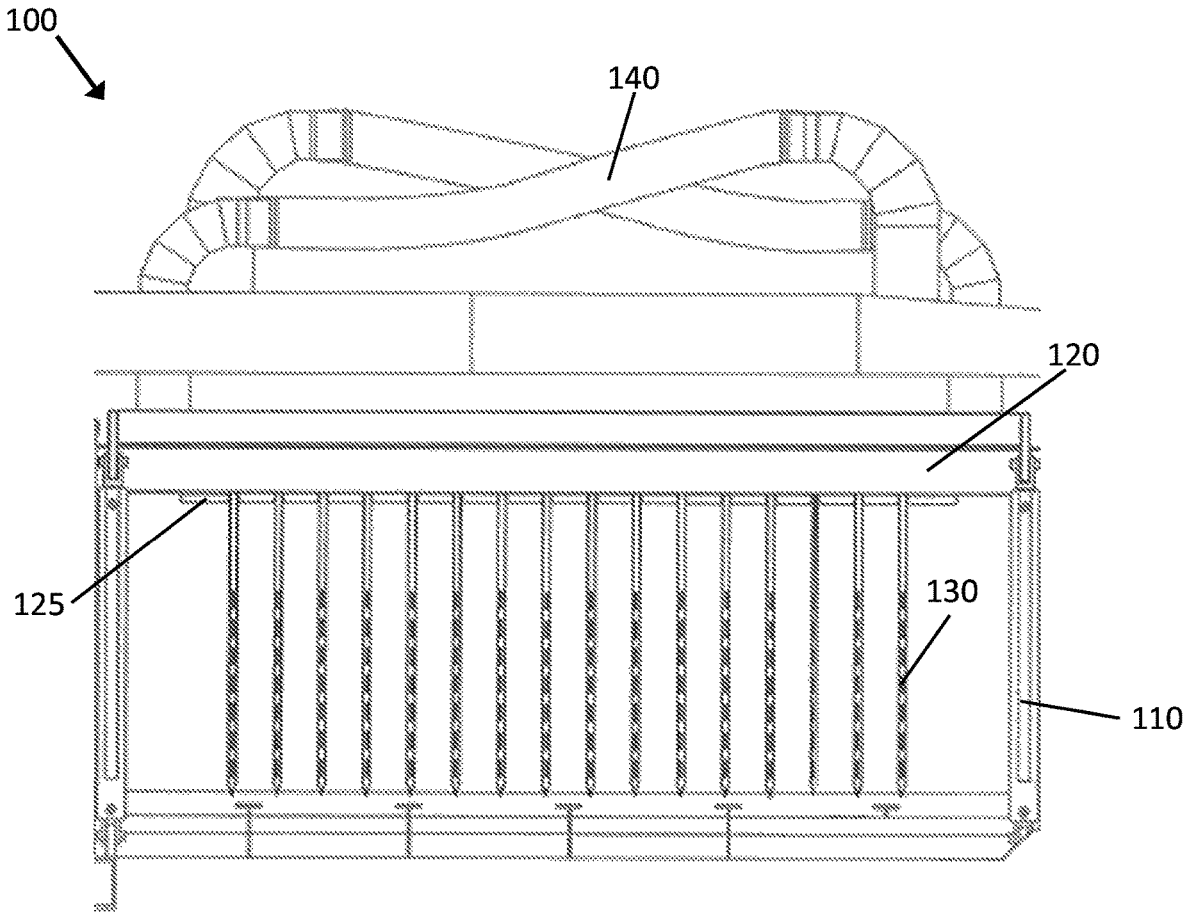
FIG. 1B is a front elevation view of the hay bale dryer of FIG. 1A with the spike rack lowered.
Figure 2A:
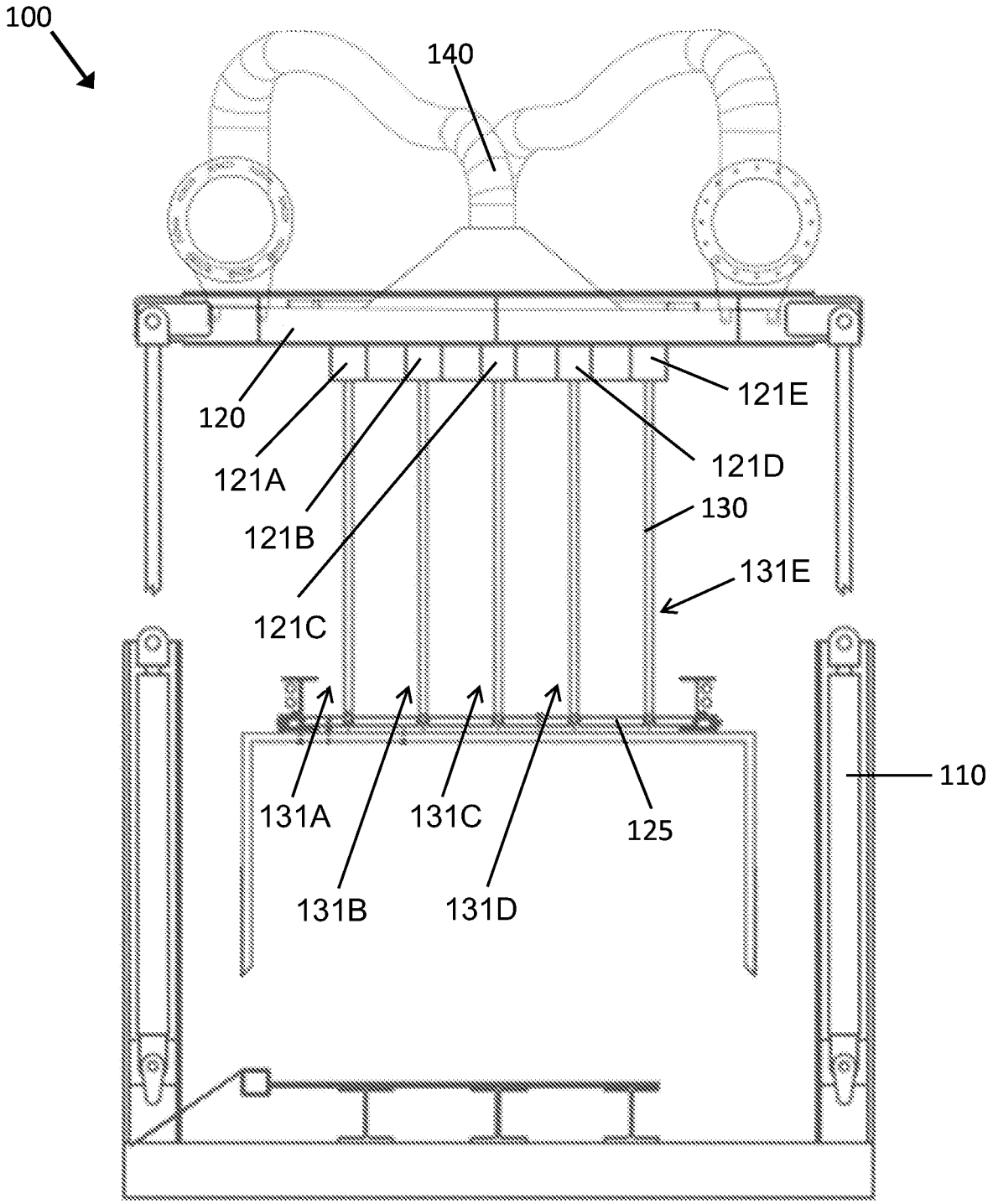
FIG. 2A is an end elevation view of the hay bale dryer of FIG. 1A with the spike rack raised.
Figure 2B:
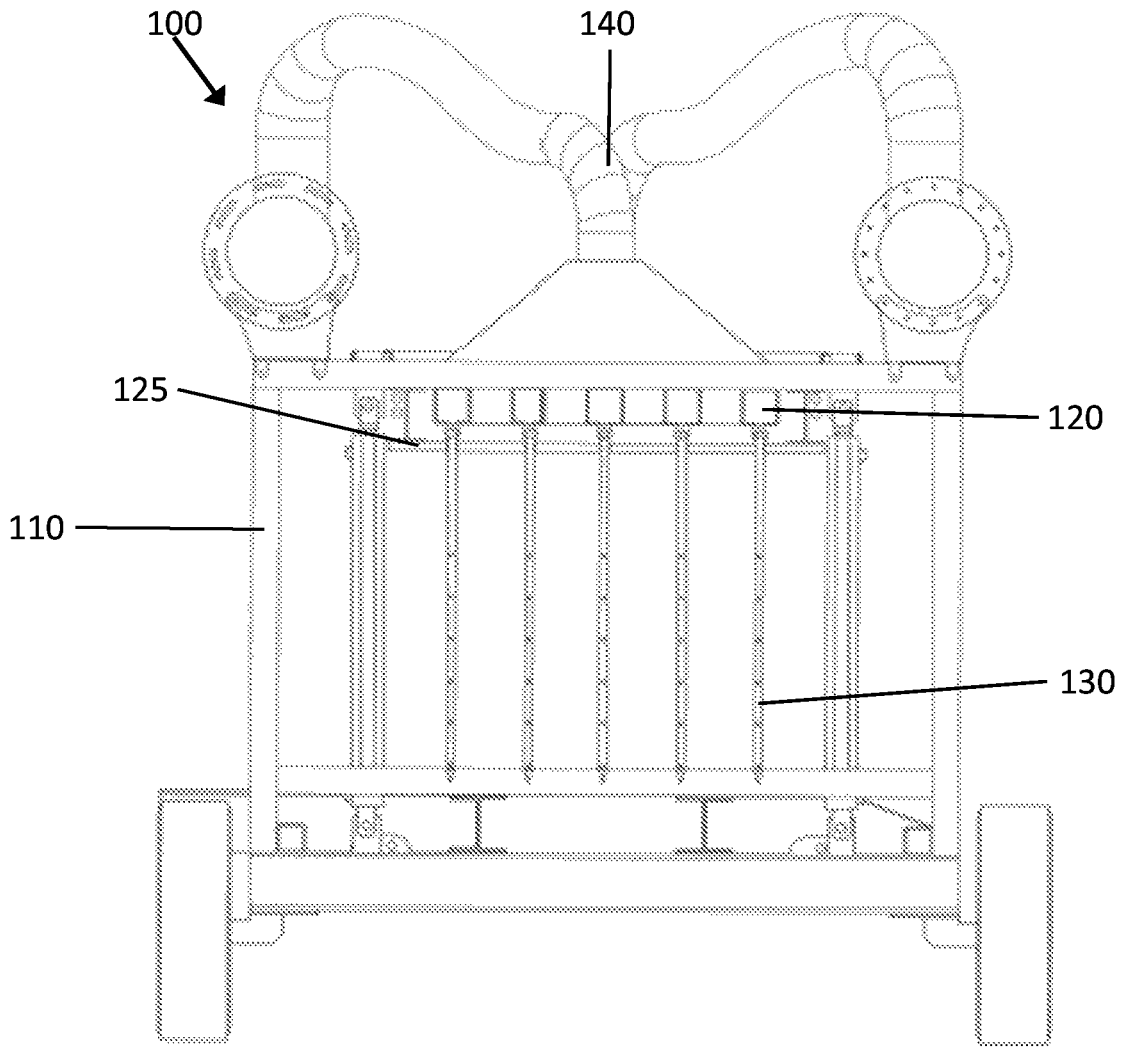
FIG. 2B is an end elevation view of the hay bale dryer of FIG. 1A with the spike rack lowered.

According to an embodiment as shown in FIGS. 1A and 1B, the dryer 100 consists of a platform 110 and a spike rack 120. Spike rack 120 may be raised to permit insertion of a hay bale (not shown) as in FIG. 1A, and may be lowered to perform the drying process, as in FIG. 1B. Each spike 130 in spike rack 120 is coupled via a respective one of air conduits 121A, 121B, 121C, 121D, and 121E to piping 140 to permit air to flow through the piping 140, from the piping 140 into each air conduit 121A, 121B, 121C, 121D, and 121E of spike rack 120, and for each air conduit of the air conduits 121A, 121B, 121C, 121D, and 121E, from the air conduit and into each spike 130 connected to the air conduit. In general, the spikes 130 may be arranged in rows, and each air conduit of the air conduits 121A, 121B, 121C, 121D, and 121E may define a respective one of the rows. For example, as shown in FIG. 2A, the spikes 130 connected to the air conduit 121A are in a row 131A along the air conduit 121A, the spikes 130 connected to the air conduit 121B are in a row 131B along the air conduit 121B, the spikes 130 connected to the air conduit 121C are in a row 131C along the air conduit 121C, the spikes 130 connected to the air conduit 121D are in a row 131D along the air conduit 121D, and the spikes 130 connected to the air conduit 121E are in a row 131E along the air conduit 121E. The air conduits 121A, 121B, 121C, 121D, and 121E are all coupled together such that the air conduits 121A, 121B, 121C, 121D, and 121E and the spikes 130 all move together relative to the platform 110 in response to movement of the spike rack 120 relative to the platform 110. Spike rack 120 may be raised and lowered by a hydraulic mechanism, and a spike guide 125 may be attached to the platform 110 to guide the spikes 130 into the hay bale. When lowered, the tips of spikes 130 should not contact the base of platform 110.

Figure 3:
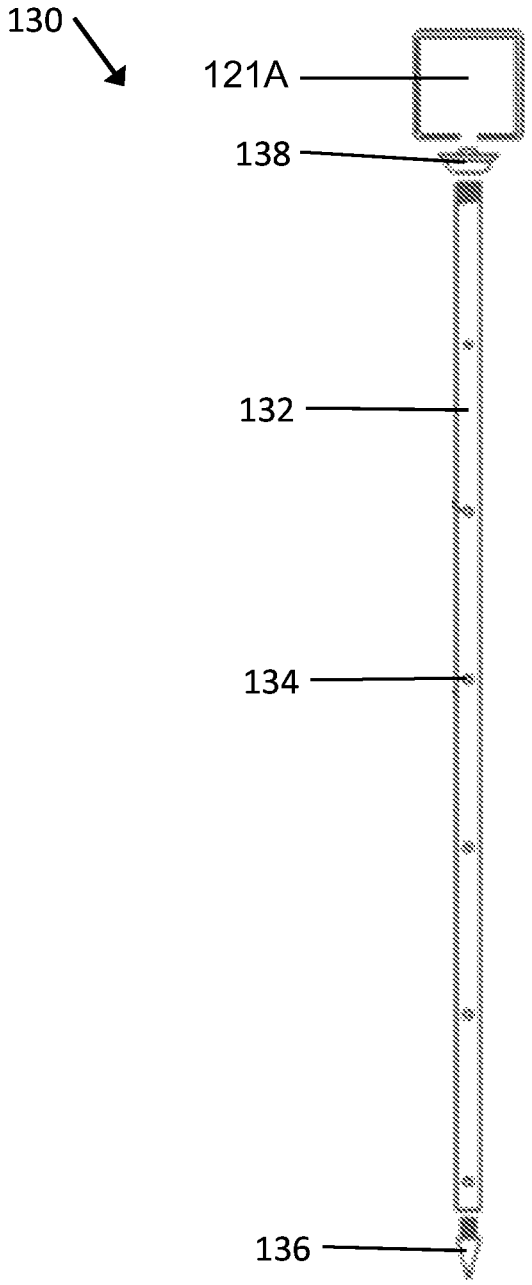
FIG. 3 is an elevation view of a spike with slots according to an embodiment.

As shown in FIG. 3, each spike 130 may be formed from a body 132, with a number of slots 134. The number, spacing and size of the slots 134 is determined by the size of the bale, the estimated average size of the hay flakes within the bale (typically 5 to 6 inches) and the fan pressure and corresponding desired air flow output through the spike. As an example, for a 3×4×8 hay bale, spikes 130 are arranged in 5 staggered rows, in three rows of 16 and 2 rows of 15 (see pattern in FIG. 5), for 78 spikes 130, with 6 slots per spike 130. For other bale sizes, different configurations may be used. For example, a 3×3×8 may have only four rows of spikes, whereas a 4×4×8 bale may require longer spikes and more slots. The desired air flow of per bale, or per spike 130 will depend on the fan pressure and the size of the slots 134. As shown in FIG. 3, spike 130 may have a detachable tip 136 and a detachable connector 138 to spike rack 120, to simplify cleaning, however, spike 130 may alternatively be formed as a single unitary piece secured to spike rack 120.

Figure 4:
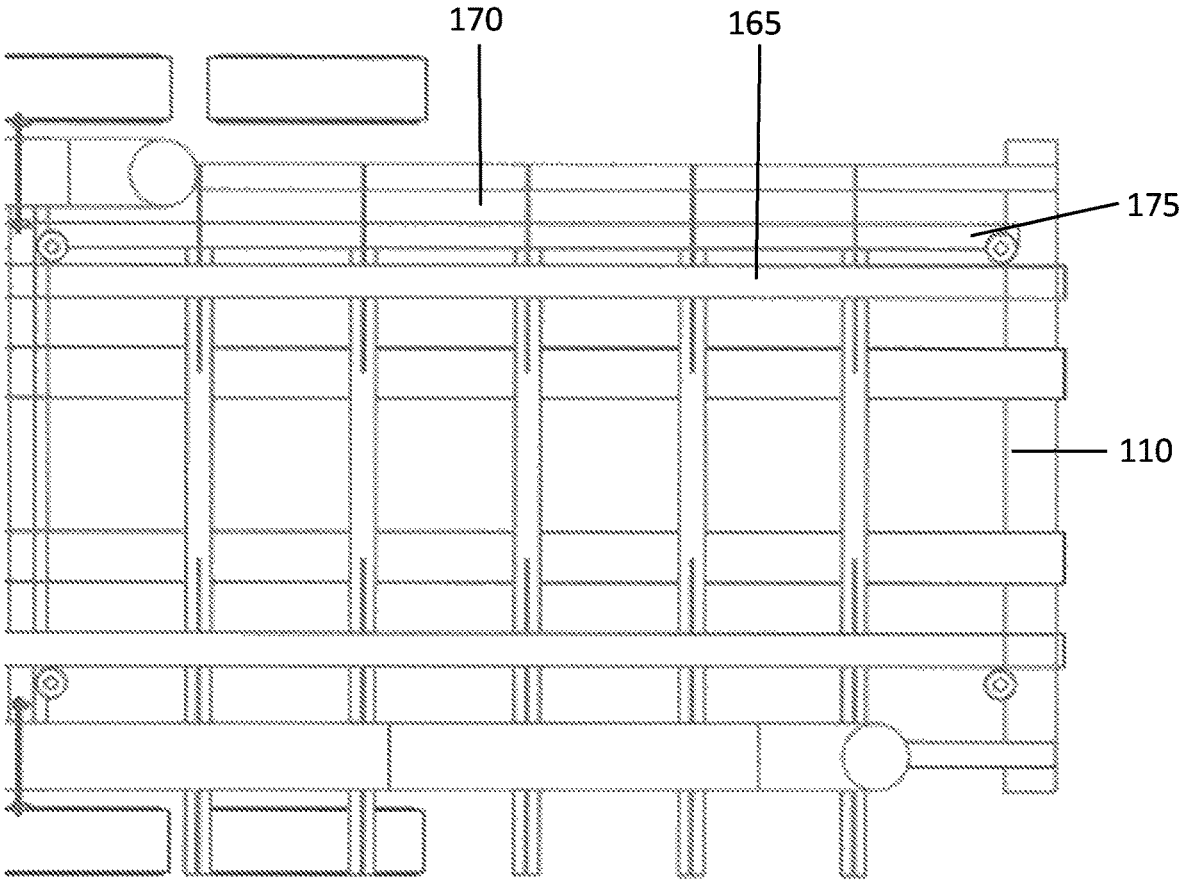
FIG. 4 is a plan view of a hay bale platform according to an embodiment.

Referring to FIG. 4, a plan view of the platform 110 is provided. Platform 110 includes a bale trap 165 to support the hay bale with a front apron 170 for loading the bale. A bale guide 175 may be provided to align the bale on the platform 110 with the spike rack 120, as shown in FIG. 5.

Figure 5:
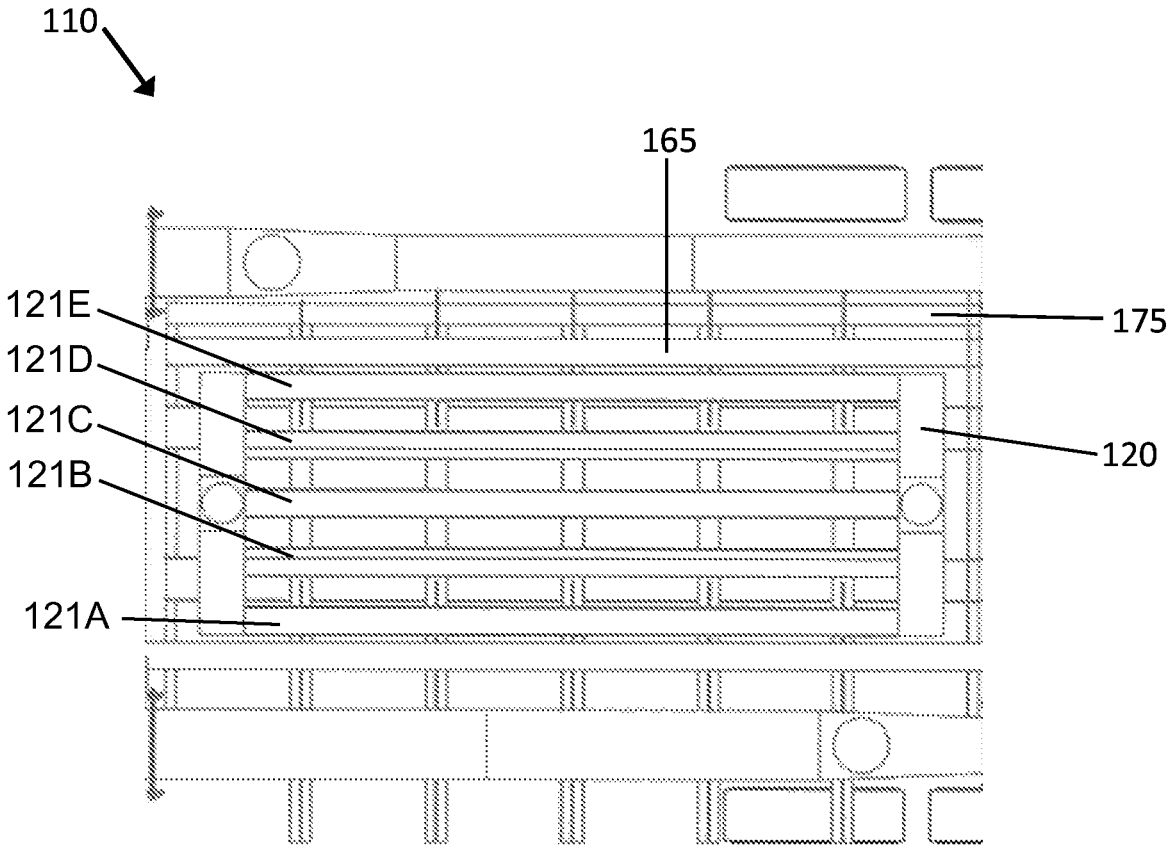
FIG. 5 is a plan view of a spike pattern according to an embodiment.
Figure 6:
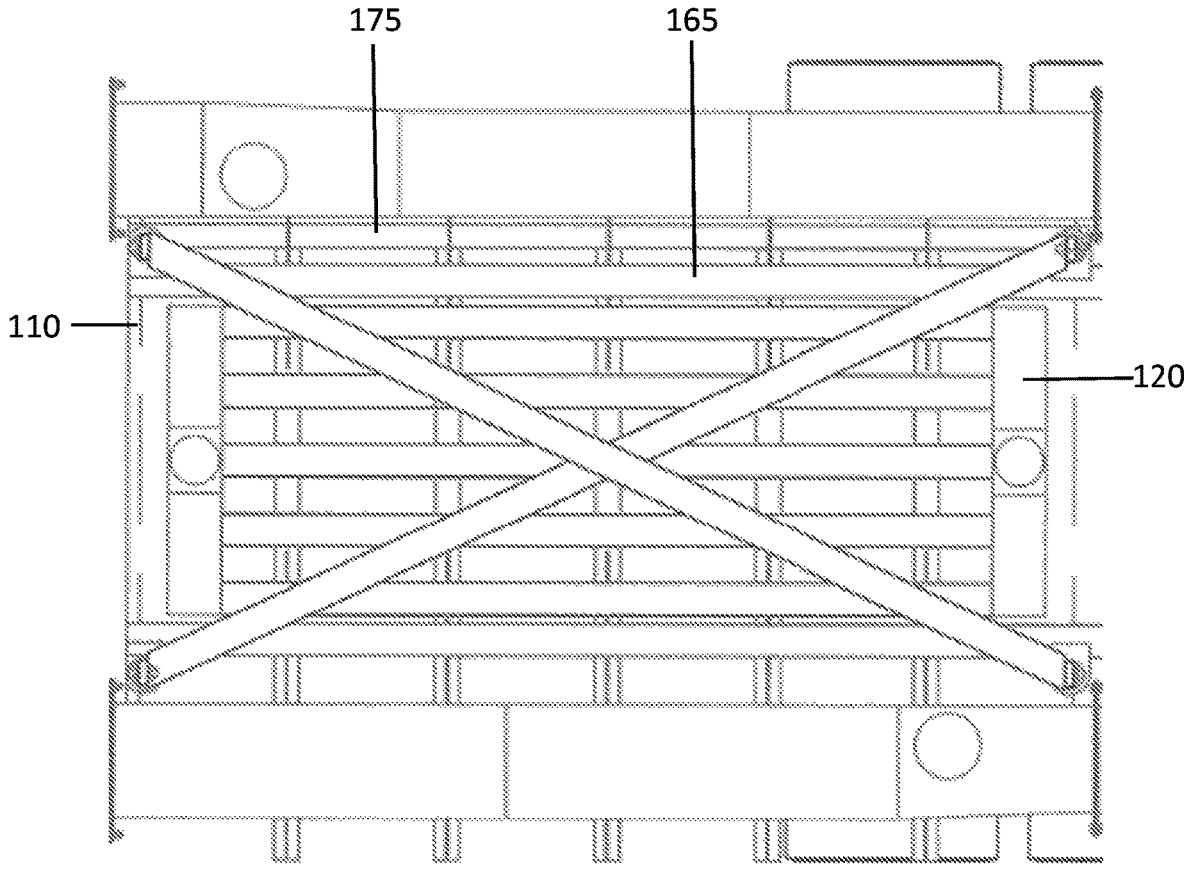
FIG. 6 is a plan view of a spike rack according to an embodiment.

FIG. 5 provides a plan view of platform 110 and spike guide 125. As discussed above for a 3×4×8 bale, 78 spikes 130 are arranged in 5 staggered rows (3×16 and 2×15) disposed within the area defined by the front apron 170 and bale guide 175. FIG. 6 shows the full assembly of spike rack 120 overlaying the platform 110.

Figure 7:
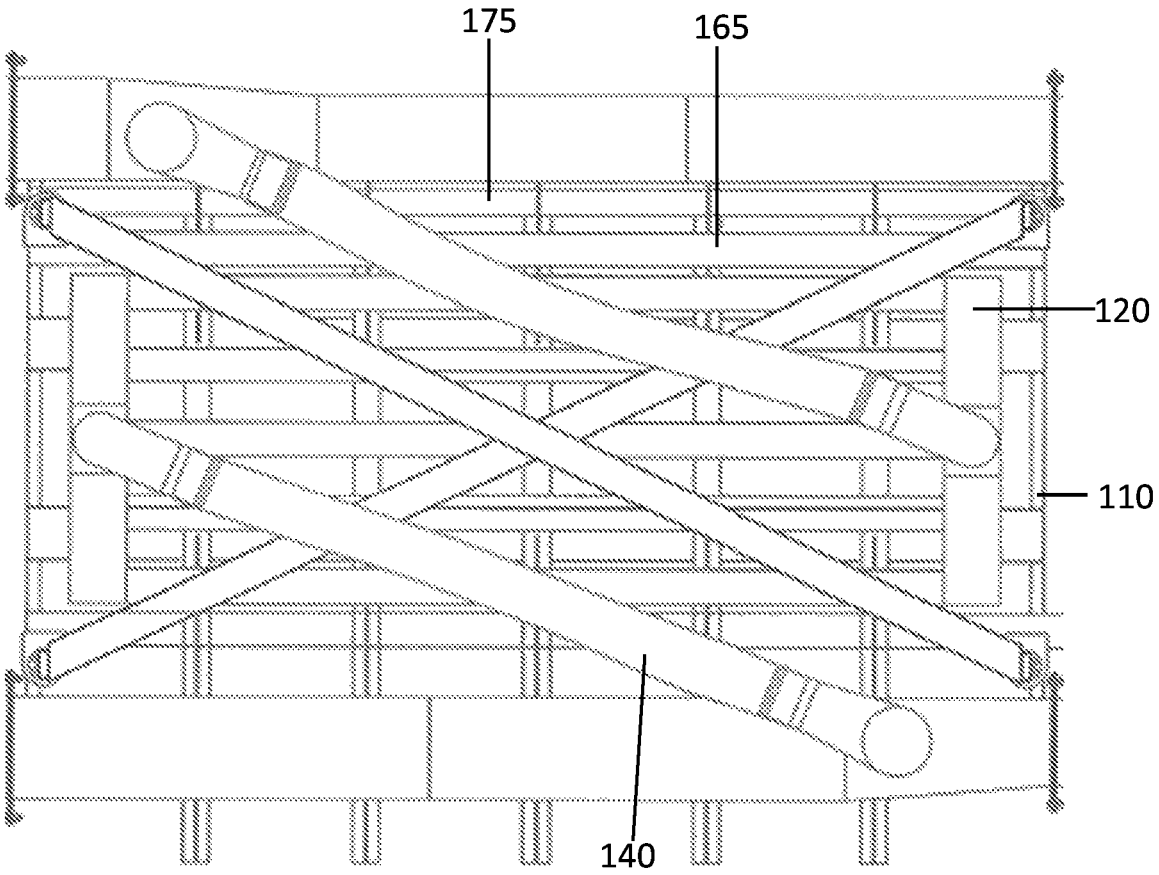
FIG. 7 is a plan view of air duct piping for a spike rack according to an embodiment.

FIG. 7 shows a plan view of piping 140 overlaying spike rack 120 and platform 110. Piping 140 should be flexible, to permit the raising and lowering of spike rack 120 without compromising the integrity of piping 140. As shown, piping 140 has a Y-split to drive down two sides of spike rack 120, however, a single piping channel may be used, depending on the required airflow, number of spikes, and fan air pressure.

In operation, a hay bale is loaded onto platform 110 with spike rack 120 raised. Front apron 170 allows the hay bale to be manually pushed onto the bale trap 165, with bale guide 175 acting to keep the bale aligned to the platform 110 and spike rack 120.

Once the hay bale is loaded, spike rack 120 is lowered, with spike 130 passing through spike guide 125 and into the hay bale. As shown above, spikes 130 pass substantially through the hay bale, but do not contact the platform 110. With the spikes 130 in place, the drying process may begin.

Figure 8:
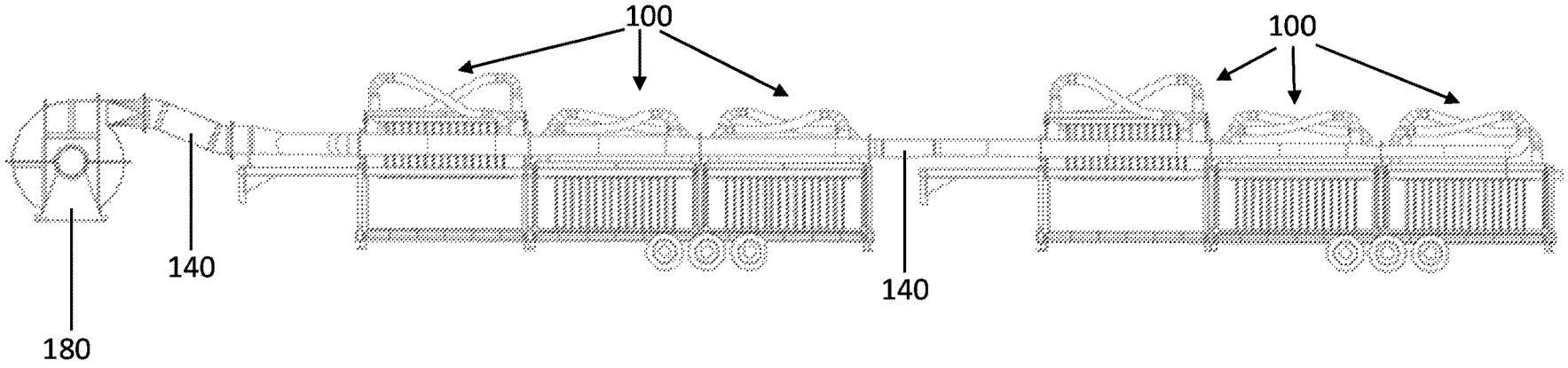
FIG. 8 is a block diagram of multiple hay bale dryers connected according to an embodiment.

To dry the bale, a fan 180 (as shown in FIG. 8) is activated to force air through the piping 140 and into the spike rack 120 and out the slots 134 in the spikes 130 to dry the hay flakes within the hay bale. When the prescribed drying time for the drying process is completed, spike rack 120 may then be raised to remove the spikes and the dry hale bale pushed through the platform. A new bale may then be placed on the platform as described and the process repeated until all bales are dry.

Using a pressure blower fan 180 to dry 3×4×8 hay bales using the five-row spike pattern described above, it was found a hay bale could be dried from approximately 25%+ moisture to 12% moisture in 10 to 15 minutes. Thus, hay may be baled at 25%+ moisture and dried to 12% moisture via hay bale dryer 100, reducing the harvesting time by 1-3 days, depending on climate conditions.

It has been found that with an electric- or diesel-powered fan, it may be possible that the heat of operation of the fan 180 is sufficient to heat the air and remove moisture as a result, permitting the drying of hay bales without additional equipment. However, in particularly cool or humid climates, or when operating at night, it may be desirable to include a heater and/or a dehumidifier as part of the fan 180. Caution should be taken to avoid overheating the air as excessive heat may lead to spoilage of the hay bale.

Referring to FIG. 8, to increase efficiencies and throughput, a plurality of hay bale dryers 100 may be connected together in line to a single fan 180 (and, optionally, heater and dehumidifier). The total number of dryers 100 operable is determined by the power of fan 180. As shown, the dryers 100 are grouped in line. The piping 140 for each dryer 100 is then connected in parallel along the main line. In testing, it was found the six or more dryers may be connected per channel without a loss in performance, for a total of six or more dryers operating from a single fan 180 as an air source.

Alternatively, the plurality of hay bale dryers 100 may be connected to the fan 180 in using one or more Y-split pipes. The overall layout of fan 180 and dryers 100 may be determined by the volume of hay bale to be dried, the space available for loading bales and locating the dryers 100 and, as discussed above, the required airflow through the spikes 130 and power of fan 180.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description and all changes which come within the meaning and range of equivalency of the claims are therefore intended to be embraced therein.

What is claimed is:

1. A hay bale dryer, comprising:

a platform, the platform dimensioned to support a hay bale;

a spike rack movably coupled to the platform, the spike rack having a plurality of spikes, each spike of the plurality of spikes dimensioned to penetrate into the hay bale, the spike rack comprising a plurality of air conduits; and piping operative to receive pressurized air and to cause pressurized air to flow from the piping into each air conduit of the plurality of air conduits, 1 wherein the spike rack is movably coupled to the platform to permit moving the spike rack between a first position to permit loading and unloading of the hay bale onto and off of the platform, and a second position different from the first position, wherein when the platform supports the hay bale and the spike rack is in the second position, the plurality of spikes penetrate into the hay bale to permit drying of the hay bale via the pressurized air through the plurality of spikes, wherein each spike of the plurality of spikes is connected to a respective air conduit of the plurality of air conduits and each air conduit of the plurality of air conduits is connected to some spikes of the plurality of spikes such that each air conduit of the plurality of air conduits is operative to cause the pressurized air, received from the piping and into the air conduit, to flow into each spike of the plurality of spikes that is connected to the air conduit, and wherein each spike of the plurality of spikes has a plurality of slots and is operative to cause pressurized air received into the spike to flow out of each slot of the plurality of slots of the spike.

2. The hay bale dryer of claim 1, wherein:

the spike rack is movably coupled to the platform to permit raising and lowering of the spike rack relative to the platform; and the raising of the spike rack permits loading and unloading of the hay bale onto and off of the platform, and the lowering of the spike rack permits drying of the hay bale via the pressurized air through the plurality of spikes when the platform supports the hay bale.

3. The hay bale dryer of claim 1, further comprising a hydraulic mechanism operative to raise and lower the spike rack.

4. The hay bale dryer of claim 1, further comprising a source of the pressurized air operative to cause the pressurized air to flow into the piping and from the piping and into each air conduit of the plurality of air conduits.

5. The hay bale dryer of claim 1, wherein the platform further comprises a spike guide aligned with the plurality of spikes such that each spike of the plurality of spikes extends through the spike guide when the spike rack is in the second position.

6. The hay bale dryer of claim 1, wherein each spike of the plurality of spikes is detachably secured to the spike rack.

7. A hay bale drying system, comprising:

a plurality of hay bale dryers, each hay bale dryer of the plurality of hay bale dryers being according to claim 1, wherein, for each hay bale dryer of the plurality of hay bale dryers, the spike rack is operative to be independently raised to permit loading and unloading of the hay bale onto and off of the platform, and lowered to permit drying of the hay bale via the pressurized air through the plurality of spikes when the platform supports the hay bale.

8. The hay bale drying system of claim 7, wherein each hay bale dryer of the plurality of hay bale dryers comprises a hydraulic mechanism operative to raise and lower the spike rack.

9. The hay bale dryer of claim 4, further comprising a heater coupled to the source of the pressurized air and operative to heat the pressurized air prior to reaching the spike rack.

10. The hay bale drying system of claim 7, further comprising a source of the pressurized air operative to cause the pressurized air to flow, for each hay bale dryer of the plurality of hay bale dryers, into the piping and from the piping and into each air conduit of the plurality of air conduits.

11. The hay bale drying system of claim 7, wherein the platform of each hay bale dryer of the plurality of hay bale dryers further comprises a spike guide aligned with the plurality of spikes such that each spike of the plurality of spikes extends through the spike guide when the spike rack is lowered to permit the drying of the hay bale via the pressurized air through the plurality of spikes when the platform supports the hay bale.

12. A method of drying a hay bale located on a platform to a desired moisture level, the method comprising:

causing pressurized air to flow into piping, from the piping and into each air conduit of a plurality of air conduits, and for each air conduit of a plurality of air conduits of a spike rack movably coupled to the platform, from the air conduit into a plurality of spikes connected to the air conduit, out of a plurality of slots in each spike of the plurality of spikes, and into the hay bale.

13. The method of claim 12, wherein the desired moisture level is 12%.

14. The method of claim 12, wherein the hay bale has an initial moisture level of 25% or greater.

15. The method of claim 12, further comprising heating the pressurized air prior to the pressurized air reaching the plurality of spikes.

16. The method of claim 12, further comprising dehumidifying the pressurized air prior to the pressurized air reaching the plurality of spikes.

17. The method of claim 12, wherein the drying process is completed within a predetermined time frame.

18. The hay bale drying system of claim 10, further comprising a heater coupled to the source of the pressurized air and operative to heat the pressurized air prior to reaching the spike racks.

19. The hay bale drying system of claim 10, further comprising a dehumidifier coupled to the source of the pressurized air and operative to remove moisture from the pressurized air prior to reaching the spike racks.

20. The hay bale dryer of claim 5, wherein the spike guide defines a plurality of through-openings, and wherein each spike of the plurality of spikes:

extends through a respective one of the plurality of through-openings when the spike rack is in the second position; and is guided by a portion of the spike guide surrounding the respective one of the plurality of through-openings as the spike rack moves to the second position.

21. The hay bale dryer of claim 4, further comprising a dehumidifier coupled to the source of the pressurized air and operative to remove moisture from the pressurized air prior to reaching the spike rack.

22. The hay bale dryer of claim 4, wherein the source of the pressurized air comprises a fan coupled to the spike rack and operative to blow the pressurized air through the plurality of slots in the plurality of spikes.

23. The hay bale dryer of claim 1, wherein the plurality of air conduits are all coupled together such that the plurality of air conduits and the plurality of spikes all move together relative to the platform in response to movement of the spike rack relative to the platform.

24. The hay bale dryer of claim 4, wherein the source of the pressurized air is operative to cause the pressurized air to flow through the plurality of slots in the plurality of spikes while the spike rack is movably coupled to the platform to permit the moving the spike rack between the first position and the second position.

25. The hay bale dryer of claim 5, wherein the spike guide is aligned with the plurality of spikes such that each spike of the plurality of spikes passes through the spike guide as the spike rack moves from the first position to the second position.

26. The hay bale drying system of claim 11, wherein the spike guide is aligned with the plurality of spikes such that each spike of the plurality of spikes passes through the spike guide as the spike rack moves from the first position to the second position.

27. The hay bale dryer of claim 1, wherein the hay bale dryer is mounted on a wheeled platform.

28. The hay bale drying system of claim 7, wherein the hay bale drying system is mounted on a wheeled platform.

29. The hay bale dryer of claim 1, wherein, for each air conduit of the plurality of air conduits, the spikes of the plurality of spikes that are connected to the air conduit are in a row along the air conduit.

* * * * *